US006688248B2

(12) United States Patent
Roodenburg

(10) Patent No.: US 6,688,248 B2
(45) Date of Patent: Feb. 10, 2004

(54) SUBMERSIBLE CATAMARAN

(75) Inventor: Joop Roodenburg, Delft (NL)

(73) Assignee: Itrec B.V., Schiedam (NL)

( * ) Notice: Subject to any disclaimer, the term of this patent is extended or adjusted under 35 U.S.C. 154(b) by 0 days.

(21) Appl. No.: 10/119,513

(22) Filed: Apr. 10, 2002

(65) Prior Publication Data

US 2003/0192465 A1 Oct. 16, 2003

(51) Int. Cl.[7] ..... B63B 1/00
(52) U.S. Cl. ..... 114/61.12
(58) Field of Search ..... 114/61.1, 61.12, 114/61.13, 61.14, 61.2, 265

(56) References Cited

U.S. PATENT DOCUMENTS 1,757,174 A 5/1930 Douglas
5,403,124 A 4/1995 Kocaman et al. ..... 405/209
6,257,165 B1 * 7/2001 Danos et al. ..... 114/265
6,550,408 B1 * 4/2003 Janssen ..... 114/121

* cited by examiner

*Primary Examiner*—Jesus D. Sotelo
(74) *Attorney, Agent, or Firm*—Buskop Law Group, P.C.; Wendy Buskop

(57) ABSTRACT

A submersible catamaran made of two parallel submergible floats, each having a triangular bow, a float midsection, a tail, and stern, a solid support surface forming a top to the two submergible floats adapted for supporting heavy loads, two movable columns disposed on the solid support surface, a fixed column on each submergible float, a ballast system disposed in each submergible float to raise and lower the catamaran with respect to the waterline, a horizontal positioning system with maneuvering winches and maneuvering lines connected to the winch and an object at sea, a controller for orienting the catamaran relative to the object at sea, and a vertical positioning system with two lines secured substantially vertically to the object at sea, two motion compensation systems disposed for monitoring the line tensions, and a control system to control the tension between the two motion compensation systems and the object at sea.

32 Claims, 12 Drawing Sheets

SUBMERSIBLE CATAMARAN

FIELD OF THE INVENTION

The present invention relates to a submersible watercraft; in particular, to a submersible watercraft having two hulls disposed generally parallel to and spaced apart from each other. At least two towers or columns are disposed generally above the hulls approximately in a longitudinal symmetry plane. The two hulls and the columns are rigidly interconnected a support surface. The towers or columns can contain propulsion and control mechanisms, crew accommodation and other equipment, such as ROV's, diver work chambers, pipeline repair gear or other operating equipment.

BACKGROUND OF THE INVENTION

Experience with oil and natural-gas exploration, production and transmission in the North Sea has shown that, because of the frequent bad weather, surface vessels can have difficulty in moving a rig or platform from the shore to an offshore location. Considerable time can be spent waiting out the storms for calm water, which is important when transporting a heavy device, such as a platform. This waiting causes a major loss of working time for surface vessels engaged in any North Sea project or project where turbulence of the water is an issue.

Moving a large platform in pieces is also expensive and time consuming, as construction now must be performed at sea, in less than stable working conditions. The present invention was developed to enable the transport of rigs and drilling platforms even in rough sea conditions by submerging to one of two levels, while retaining the option to operate in a normal draft.

German Offenlegungsschrift 23 56 537 discloses a catamaran surface vessel having a submersible gondola located between the two hulls of the catamaran. The catamaran remains afloat when the gondola is lowered for underwater travel. The submersible gondola has a torpedo-like shape widely used for self-propelled underwater craft because of its low resistance to motion for the volume of water displaced, relative to other shapes. Although the catamaran, by virtue of the form stability provided by its two spaced-apart hulls, has a high resistance to capsizing, it is nonetheless susceptible to bad weather and rough seas as are other surface vessels. U.S. Pat. No. 1,757,174 to Douglas discloses a seagoing vessel having five pontoons: a cabin pontoon, two waterline pontoons, and two power pontoons. The two waterline pontoons are disposed below and to either side of the cabin pontoon. A power pontoon is disposed below each waterline pontoon. The vessel of U.S. Pat. No. 1,757,174 is a surface vessel. Only the power pontoons, located beneath the waterline pontoons, are submerged when the vessel is under way. Consequently, the vessel is also affected by heavy seas.

A need has existed for vessels, which can have substantially the body of the vessel, submerged and still move through the water.

SUMMARY OF THE INVENTION

A submersible catamaran having a bow and a stern further comprising: a first submergible float comprising a first float rounded triangular bow, a first float midsection, a first float tail, and first float stern; a second submergible float comprising a second float rounded triangular bow, second float midsection, second float tail, and second float stern, wherein the second submergible float is disposed in a parallel relation to the first submergible float; a solid support surface forming a top to the first and second submergible floats and wherein the solid support surface is adapted for supporting heavy loads and forming an air gap between the first and second submergible floats and the solid support surface and a slot opening disposed between first and second submergible float tails; a first load supporting movable column disposed on the solid support surface; a second load supporting movable column disposed on the solid support surface; a first fixed column disposed on the first submergible float; a second fixed column disposed on the second submergible float; a first ballast system disposed in the first submergible float; a second ballast system disposed the second submergible float, wherein the first and second ballast systems are adapted to raise and lower the catamaran with respect to the waterline; a horizontal positioning system comprising: at least three horizontal maneuvering winches; at least three maneuvering lines, each connected on one end to a winch and on the other end to an horizontal maneuvering object at sea; and a controller for orienting the catamaran relative to the object at sea, and wherein the controller monitors the tension on the maneuvering lines and the controller initiates winch pay out of the maneuvering line when load on any one of the maneuvering lines exceeds a first preset limit, and further the controller initiates the maneuvering winch tensioning of the maneuvering line when tension on any one of the maneuvering lines falls below a second preset limit; and a vertical positioning system for securing the catamaran to an object at sea; a first line secured on one end substantially vertically to an object at sea; a second line secured on one end substantially vertically to the object at sea; a first motion compensation system disposed in the first load supporting moveable column and connected to the other end of the first line; a second motion compensation system disposed in the second load supporting moveable column and connected to the other end of the second line; and a control system for monitoring and controlling tension between first and second motion compensation system and the object at sea.

DETAILED DESCRIPTION OF THE PREFERRED EMBODIMENTS

The present invention has as its object to provide a vessel, which may be employed as floating watercraft and as a submersible vessel, which can be used in a wide variety of weather conditions.

Figure 1:
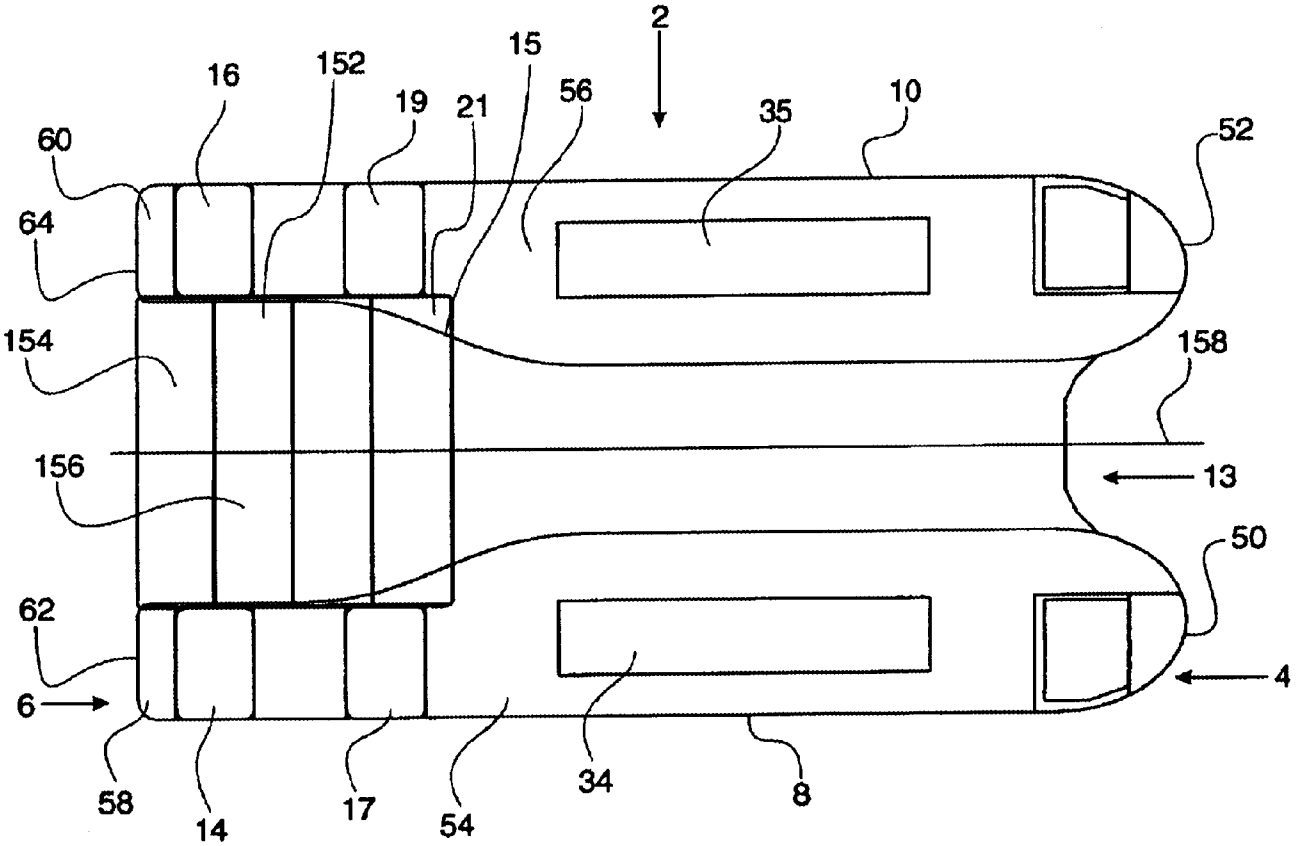
FIG. 1 is a top view of the catamaran with ballast systems.

Referring to FIG. 1, the invention is a submersible catamaran (2) having a bow (4) and a stern (6). The vessel has a first submergible float (8) and a second submergible float (10).

The first and second submergible floats each have a similar construction of bow, midsection and stern section, the latter being referred to hereafter as the tail.

In particular, the first submergible float has a first float rounded triangular bow (50) a first float midsection (54) a first float tail (58) and first float stern (62). The second submergible float (10) has a second float rounded triangular bow (52), second float midsection (56), second float tail (60) and second float stem (64). The first and second submergible floats are disposed in a parallel relation to each other along a center line (158). In one embodiment, the first float tail (58) and the second float tail (60) have a tapered shape. Alternatively they can be of a rectangular design, however the tapered shape enables easier positioning of the vessel when engaging objects at sea.

FIG. 1 also shows that each submergible float has a ballast system. First submergible float (8) has ballast tank (34) and second submergible float (10) has ballast tank (35). An air gap (13), which is shown in better detail in later Figures, is disposed between the first and second submergible floats and the solid support surface (12), shown in FIG. 2. A slot opening (15) is disposed between first and second submergible float tails. The slot opening in a preferred embodiment is between 10 and 80 meters in width and 10–80 meters in length. In a most preferred embodiment the slot opening (15) is 50 meters in width. Preferably, the slot opening (15) has a U-shape. The slot opening (15) is sized to position at least partially around a structure in a marine environment, such as around a jacket or a spar or similar deep draft floating caisson structure as shown in more detail in FIG. 7. Other structures which could be positioned in slot opening (15) include a floating platform, a fixed leg platform or another floating vessel.

Figure 2:
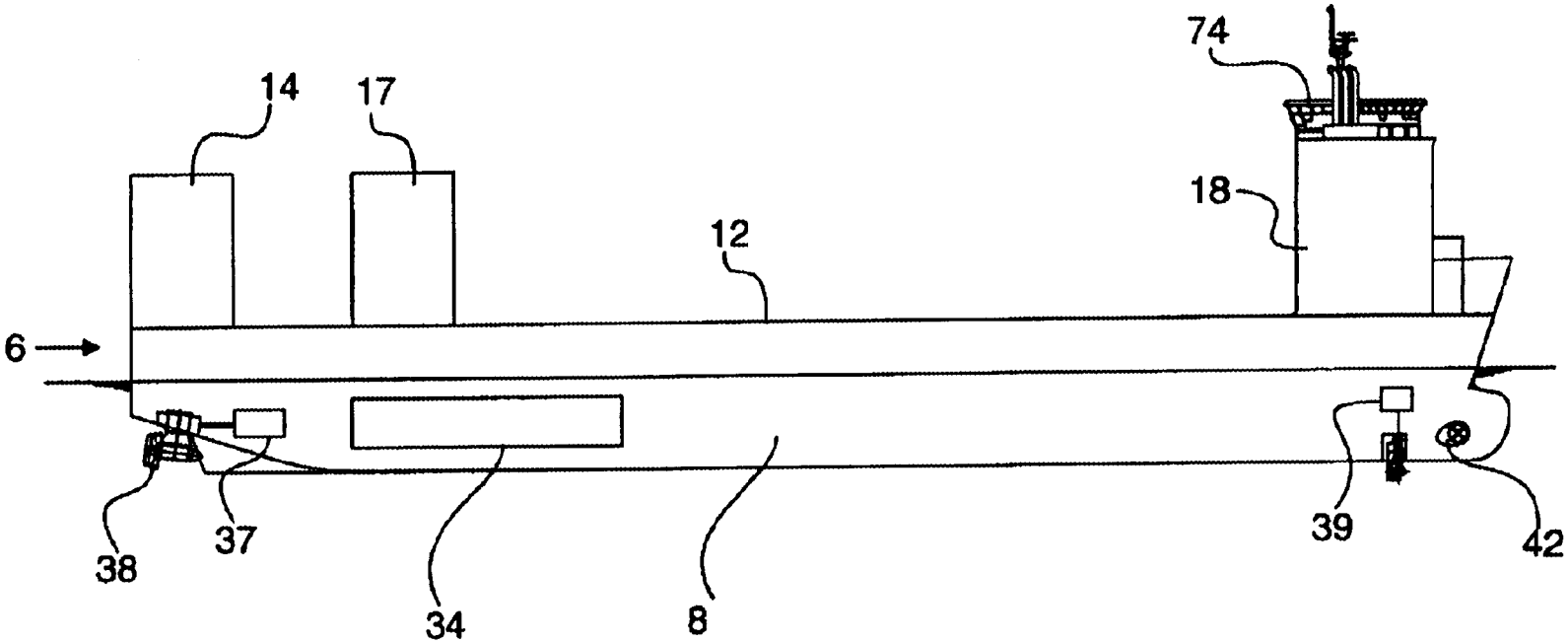
FIG. 2 is a starboard view of the catamaran with two moveable columns.

FIG. 2 is a starboard view of the vessel, shows that the solid support surface (12) forms a top on the first and second submergible floats. This solid support surface (12) can support very heavy loads.

At least two load supporting moveable column (14) and (17) can be disposed on the surface of solid support surface (12). Additional moveable columns are also contemplated as usable on this vessel. These load supporting moveable columns can support very heavy loads, such as a top sides, or objects, such as plates of steel or a hatch can be placed on the load supporting moveable columns and then a load placed on the hatch. These load supporting moveable columns can also be used as a lifting device in combination with a hatch of the vessel.

Returning to FIG. 1, four load supporting moveable columns are shown, as (14), (16), (17) and (19). In a most preferred embodiment, four moveable support columns are contemplated, two disposed on the first submergible float and two disposed on the second submergible float. However, it should be noted that between 2 and 10 load supporting moveable columns could be used on a vessel. These columns can be skiddable on the solid support surface. Alternatively, these columns can be detachable from the solid support surface.

The support columns are detachably fitted on the floats. This has the advantage that the support columns can be removed from the vessel at the point in time when they are not needed. This makes a difference in weight and, furthermore, space is made free on the deck in this way.

Furthermore, it is advantageous if the position of the support columns on the floating body is adjustable. The construction of the vessel according to the invention is so rigid and so strong that the position of the support columns on the floating bodies can be freely chosen. The support columns can be placed in an optimum position on the vessel, depending on the load that has to be transported. The support columns can be positioned close to the stern of the vessel. The fixed columns, with the crew accommodation therein, are at the bow of the vessel. Two fixed columns can also be disposed on the submergible floats, preferably one on each float.

According to the invention it is possible that the open space between the two floating bodies is filled by so-called hatches in order to increase the effective surface area of the solid support surface. According to the invention provision is made that these hatches can be fixed to the side of the floats. In this case the volume of the vessel is appreciably increased at this location. As a result the lifting capacity of the vessel will be increased at the location of the hatches, when disposed between the floats.

Figure 3:
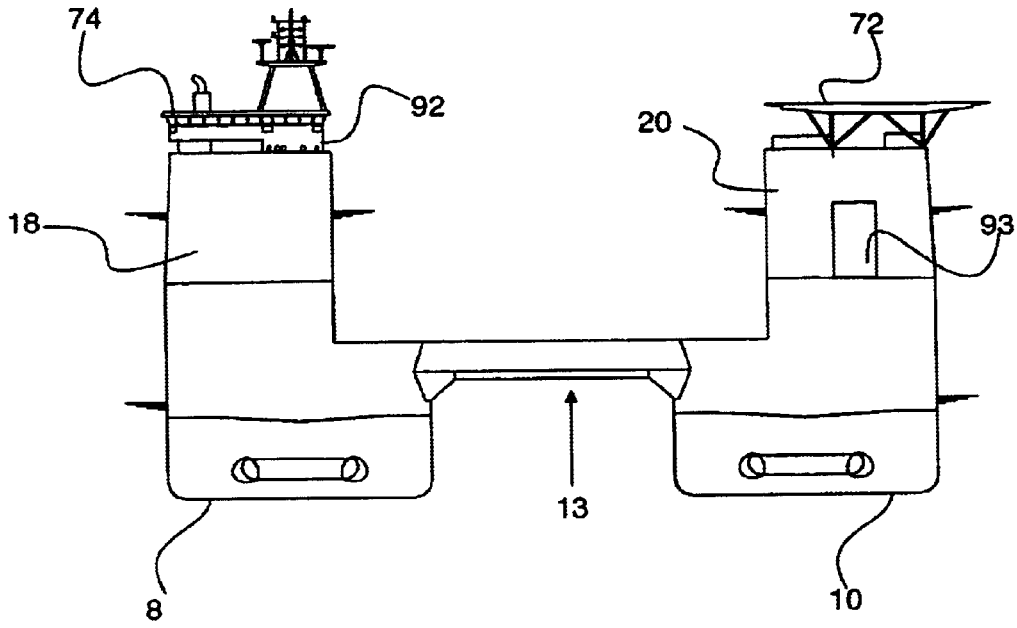
FIG. 3 is a bow on view of the catamaran showing air gap 13.

FIG. 2 shows one of the two fixed columns, the first fixed column (18) disposed on the submergible float (8). FIG. 3 shows the second fixed column (20) disposed on the second submergible float (10). These fixed columns are contemplated to be single hulled or double hulled. Double hulling is helpful for safety purposes to prevent destabilization if an impact to the column occurs. This vessel is an energy saving vessel, because less support vessels are needed offshore with fewer/less load transfers to install platforms and equipment on offshore platforms.

Returning to FIG. 2, the ballast system (34) is shown disposed in the submergible float (8). It is contemplated that at least two ballast systems are used, one for each submergible float. FIG. 1 shows the preferred positioning of each of the two ballast tanks, which would be used in this vessel. These ballast systems are used to raise and lower the catamaran with respect to the waterline. The ballast systems can be used to keep the catamaran at first, a normal draft, or second, a slightly submerged draft, wherein water fills the air gap (13) between the first and second submergible floats (8) and (10) and the solid support surface (12) is above the water level, or third, a lower draft, wherein between 1 and 20 meters of water covers the solid support surface (12). These three drafts are explained in more detail with reference to FIG. 5. It is contemplated that the first and second ballast systems (34) and (35), shown in FIG. 1, can be used to raise and lower the catamaran between 10 and 90 percent of the overall height of the catamaran.

Returning to FIG. 2, an optional propulsion system comprised of rotatable propellers and bow thrusters is shown for one of the two submergible floats. In particular, reference number (38) is a rotatable propeller connected to an engine (37), and reference numeral (39) is a thruster as is reference numeral (42). At least three propulsion devices can be located in each submergible float as an option. The equipment for operating these devices can be contained in the fixed column (18) and (20) or located in the floats. FIG. 3 provides additional detail that the fixed columns (18) can contain crew accommodations (92) and/or a bridge command center, such as a navigational bridge (74) for piloting and commanding the vessel. The fixed column can contain catamaran operational equipment (93). The fixed columns can also support a helipad or second deck (72) as shown in this Figure.

It is contemplated as an option that each fixed column could support different structures. (74). Also notable in FIG. 3 is the air gap (13) disposed between the two submergible floats.

Figure 4:
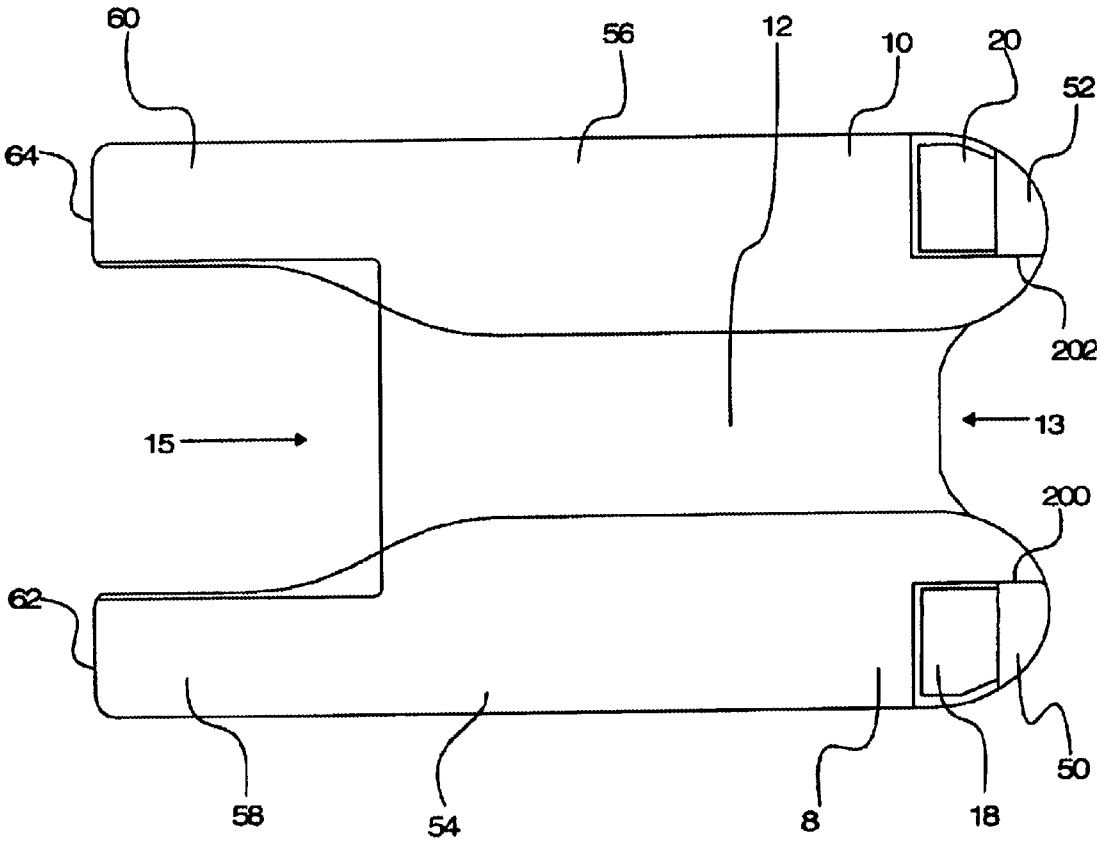
FIG. 4 is a top view of the catamaran showing the bow structure as rounded triangular

FIG. 4 shows a top view of the catamaran with the air gap (13) and the slot (15) as well as the support deck (12) in a position where the slot (15) is not covered by hatches. In this Figure, the two fixed columns (20) and (18) are shown disposed on the submergible floats. FIG. 4 shows the bow structure having the unique rounded triangular shape for each submergible float. The edges are shown as reference numeral (200) for float (8) and reference numeral (202) for float (10).

Figure 5:
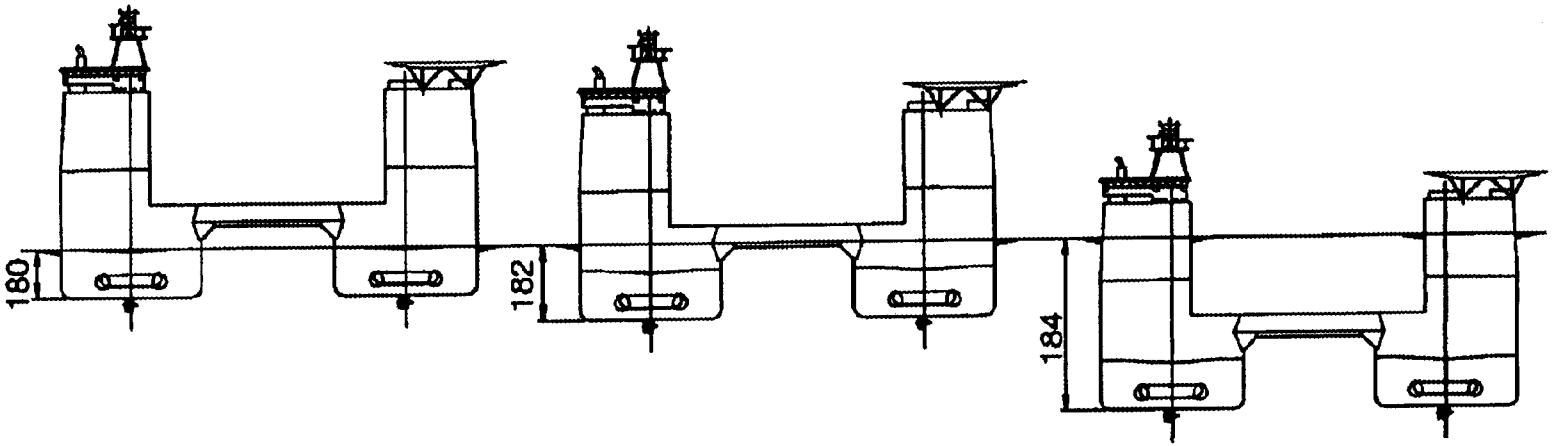
FIG. 5 shows three typical drafts for the catamaran

FIG. 5 shows the way in which the catamaran can be submerged to at least 3 different draft depths. The first depth is shown as reference numeral (180), the second depth is shown as reference numeral (182) and the third depth is shown at reference numeral (184). It is contemplated that the vessel can move at any of these depths.

Figure 6:
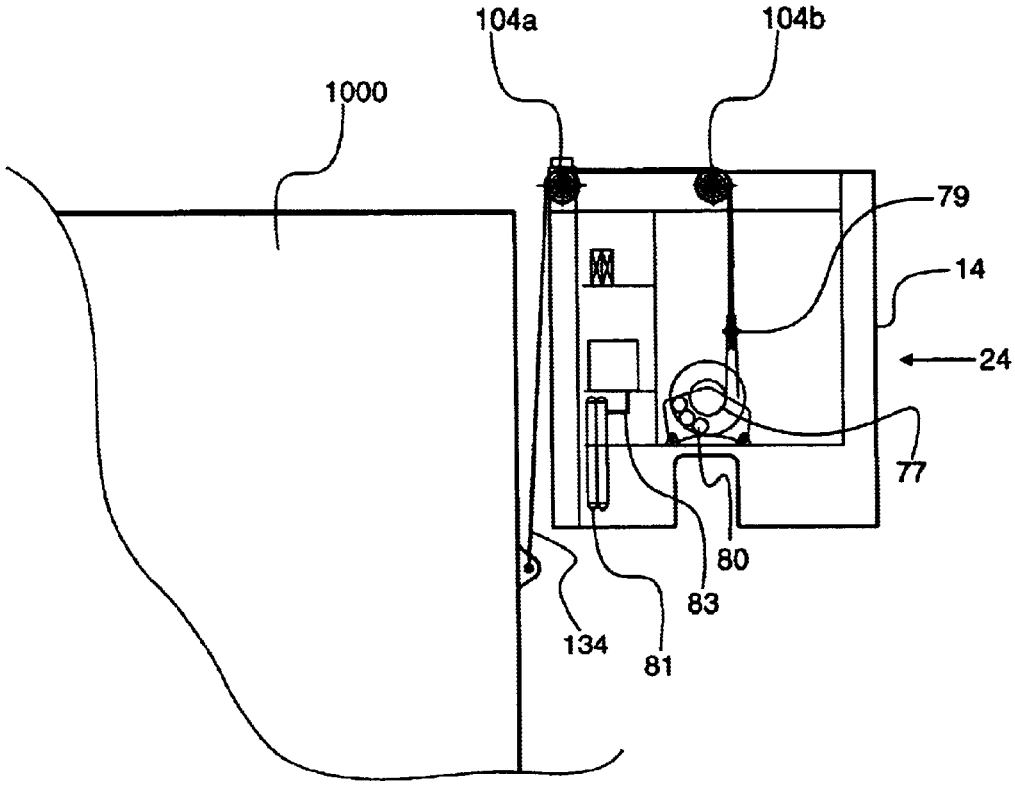
FIG. 6 shows a vertical positioning system usable on the catamaran disposed in a moveable column.

FIG. 6 shows one element of the vertical positioning system (24), which is installed in at least two of the moveable columns and used for securing the catamaran to an Ma object at sea. A first line (134) connects to an object at sea (1000). One end of this line (134) is secured substantially vertically to an object at sea (1000). The angle of, attachment is usually not more than between 0 and 30 degrees from the vertical. Typically a second line (135) is used, as shown in FIG. 7 and is also secured on one end, substantially vertically, no more than between 5 and 30 degrees from the vertical, to the same object at sea.

The object at sea (1000) is fitted into the opening slot (15) of the catamaran and secured with both lines. FIG. 7 shows the object at sea secured in the opening slot (15).

Figure 7:
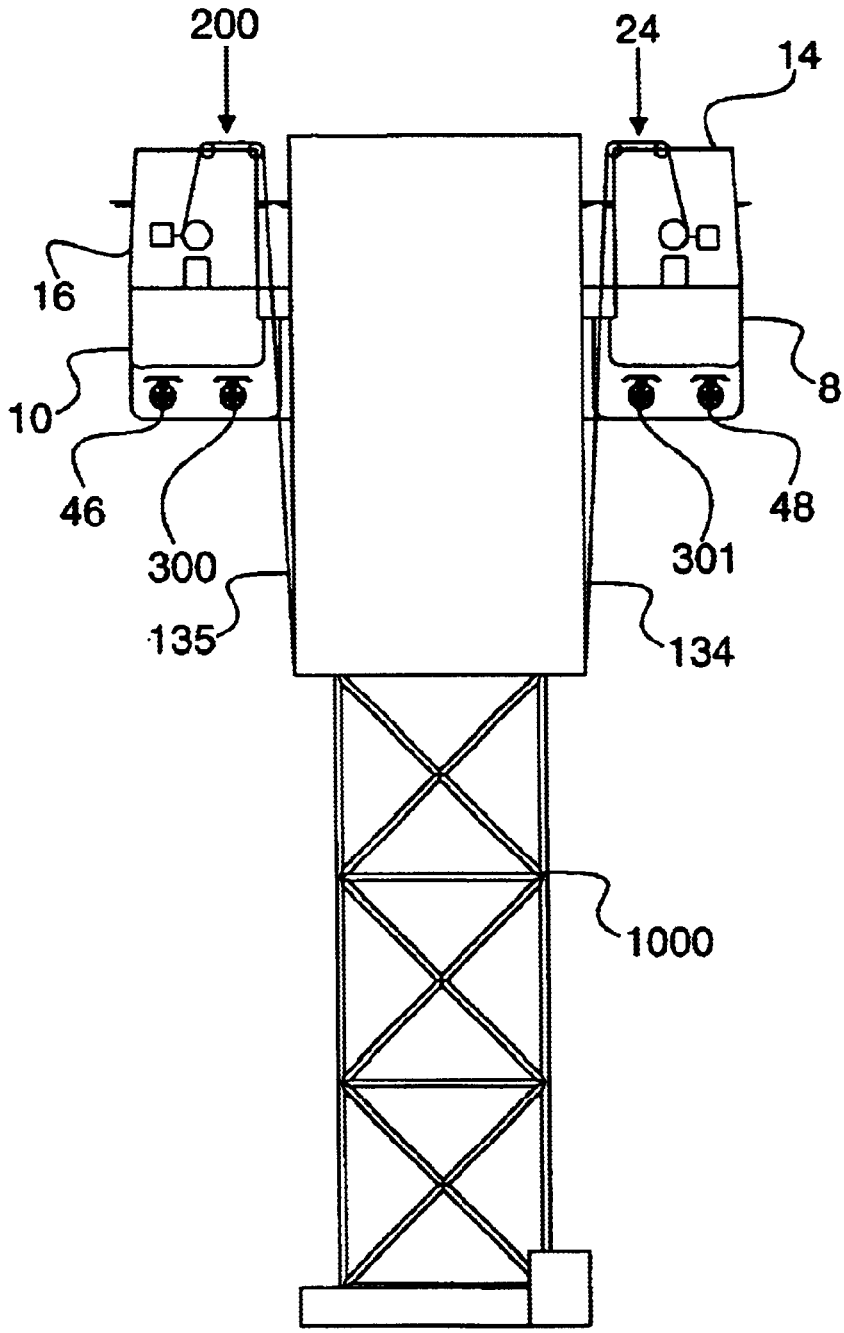
FIG. 7 shows the catamaran from the stem view using the vertical positioning system on an object at sea.

FIG. 7 is a stern view of the catamaran wherein, the submersible hull (8) and the submersible hull (10) can be seen, as well as two moveable columns (14) and (16) each containing a vertical positioning device with motion compensation system. Specifically, moveable column (14) contains the first vertical positioning device (24) and moveable column (116) contains the second vertical positioning device (200).

Returning to the detail of FIG. 6, the vertical positioning system is a motion compensation system (138) disposed in the first load supporting moveable column (14). The other end of first line (134) engages this motion compensation system. In the second load supporting moveable column (16), an identical second motion compensation system is located and connected to the other end of the second line (135) (shown in FIG. 7).

The first and second motion compensation systems (138) and (200) each comprise the same elements, which are shown in detail in FIG. 6. Specifically the systems is include a winch (77), the line (134) or (135) connected to the winch and vertically connectable to the object at sea (1000), a tension measuring device (79) connected to the line; a motion control device (80) connected to the line and winch for monitoring and controlling tension on the line. Sheaves or rollers or wheels (104*a*) and (104*b*) can be used to assist in the. tensioning of the line. These rollers are preferably mounted at the top of the moveable columns, and the tensioning devices are mounted at the bottom of the device. The motion compensation systems also each comprise an accumulation system (81) connected to a hydraulic system (83) for energy storage as the load is lifted. Between 1 and 16 winches can be used in each motion compensation system, for vertical and horizontal positioning, and least two winches are used in the system.

Figure 8:
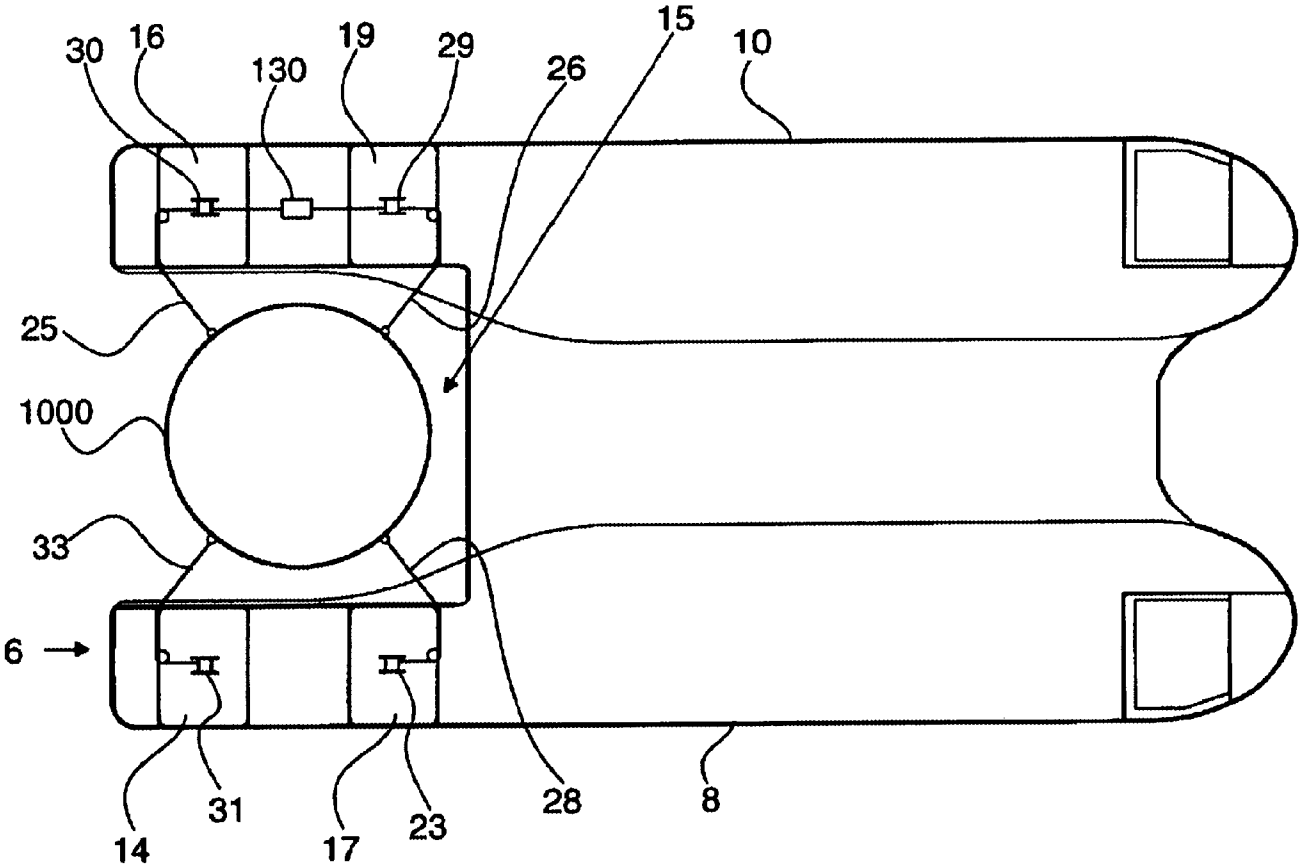
FIG. 8 is a top view of the catamaran using the vertical positioning system described in FIG. 7.

A horizontal positioning system is also used on the vessel. This horizontal positioning can be a dynamic positioning system. FIG. 8 shows the horizontal positioning system holding a spar or floating deep draft cassion vessel in the opening slot (15). The horizontal positioning system preferably consists of at least three maneuvering lines (25), (26), and (28) although four are shown in FIG. 8, with the fourth maneuvering line having reference numeral (33). Each line is connected on one end to a maneuvering winch. Line (26) connects to winch (19), line (25) connects to winch (30) line (28) connected to winch (23). The other end of each line connects to the object at sea (1000). It should be noted that if the fourth line (33) were used, it would be connected to a maneuvering winch (31). Each winch is disposed in a load-supporting column. Winch (23) is in column (17), winch (19) is in column (29), winch (30) is in column (16) and optional winch (31) is in column (14).

A controller (130) for orienting the catamaran relative to the object at sea (1000) is electrically connected to the winches and the motion compensation systems. The controller monitors the tension on the maneuvering lines and the controller initiates winch pay out of the maneuvering line when load on any one of the maneuvering lines exceeds a first preset limit. The controller initiates the maneuvering winch tensioning of the maneuvering lines when tension on any one of the maneuvering lines falls below a second preset limit. All winches are used to reduce the relative motion between the two bodies. When the bodies move away from each other, the winches go to a high preset tension. When the bodies move towards each other, the winches go to a low preset tension.

The present invention relates to a vessel, which can include a propulsion system. However, this vessel may be propulsion-less, and simply be towable and work within the scope of the invention for lifting, transport and maintenance of objects at sea.

Figure 9:
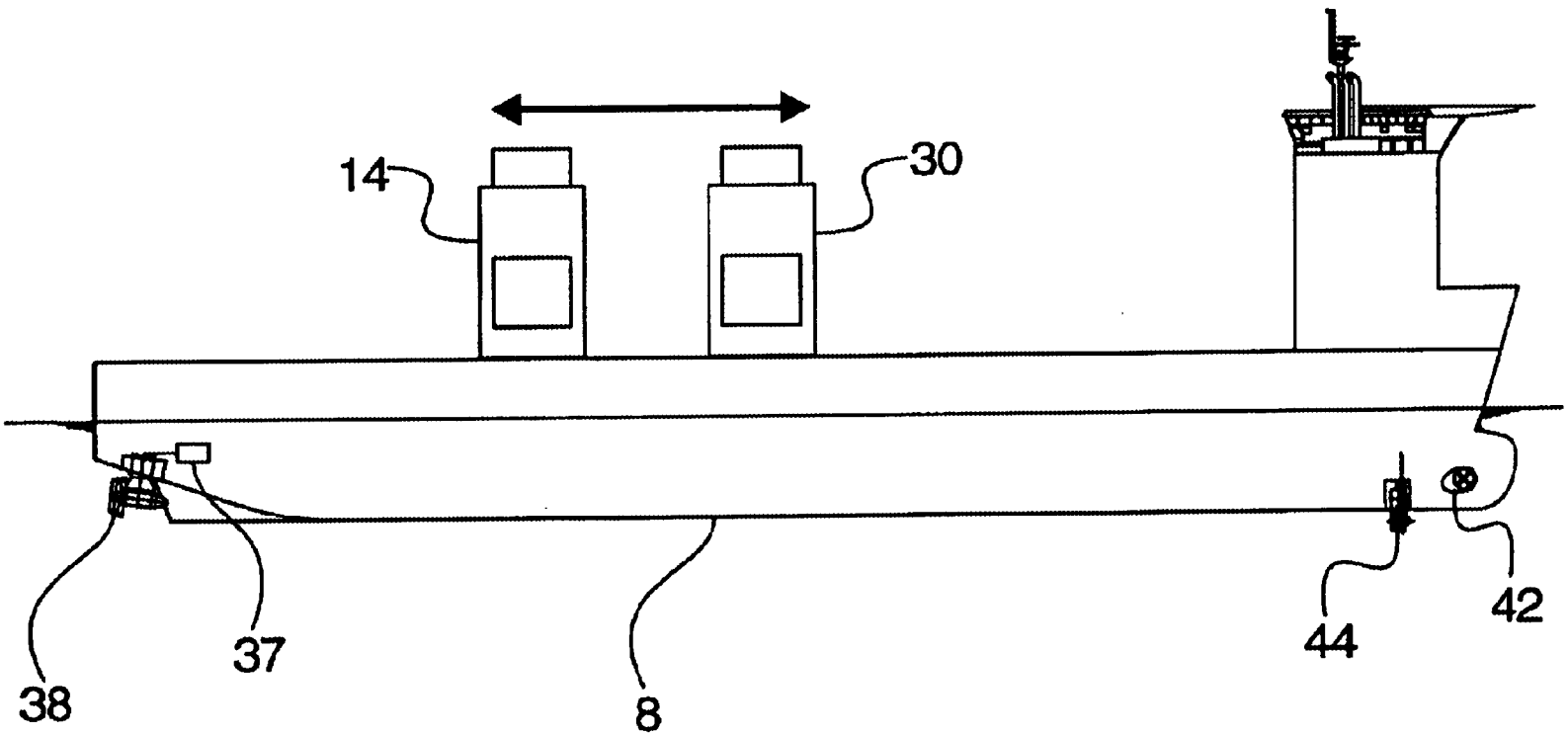
FIG. 9 shows the catamaran wherein two of the moveable columns have been moved from positions on extreme ends of the submergible floats to a center area of the solid support structure.

FIG. 9 shows one embodiment of a propulsion system usable on the vessel. A mirror image for the port side of the vessel is contemplated for this propulsion system. This starboard side has a first engine (37), shown in FIG. 2, in the first submergible float (8) driving a first rotatable propeller (38). A second engine is the second submergible float for driving a second rotatable propeller also disposed on the stern of the second submergible float.

The propulsion system can optionally comprises a first bow thruster (42) disposed in the bow of the first submergible float (8) connected to the propulsion system, and a second bow thruster (44) disposed in the float connected to the propulsion system.

Returning to FIG. 7, another embodiment contemplates that the propulsion system further can comprises a first stem thruster (46) disposed in submergible float (10) connected to the propulsion system and a second stem thruster (48) can be disposed in the second submergible float (8). These two thrusters can be used with the two rotatable propellers previously described. In still another embodiment, two stem thrusters can be used in each submersible float. FIG. 7 shows the four stem thruster embodiment with the additional stem thrusters noted at (300) and (301). Essentially, the catamaran can comprise a propulsion system consisting of a plurality of bow and stem thrusters.

The present invention is contemplated to include one or more hatches. The solid support surface (12) can comprises at least one removable hatch. In a preferred embodiment, the hatch can float. FIG. 1 shows removable hatch (21), (152), (154) and (156) disposed over the opening slot (15).

Figure 10:
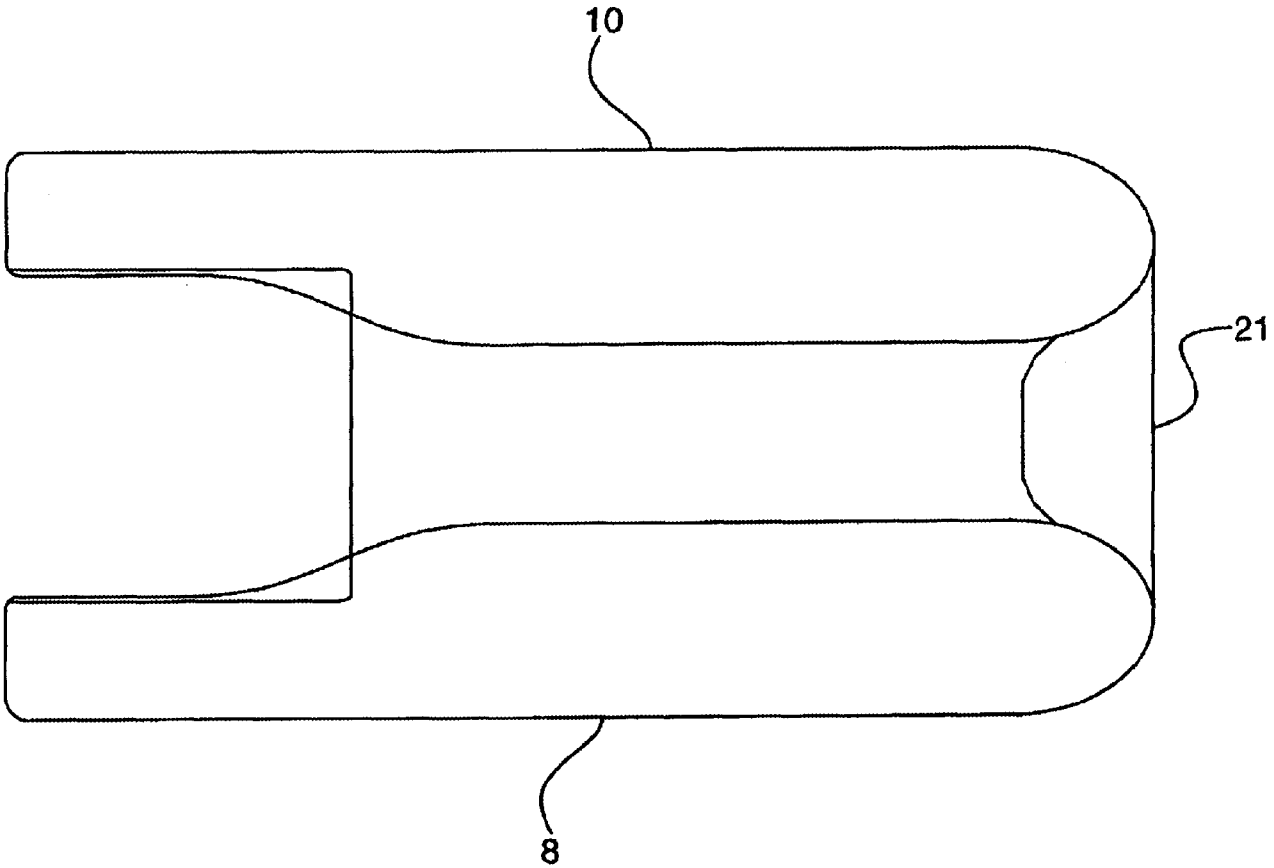
FIG. 10 is a top view of the catamaran with the hatch across the bow.

In a safety mode for moving the catamaran, it is contemplated that the removable hatch can be placed between the bows of the first and second submergible floats to prevent water from coming over the solid support surface (12). FIG. 10 shows the hatch (21) disposed across the bow of the vessel.

Figure 11:
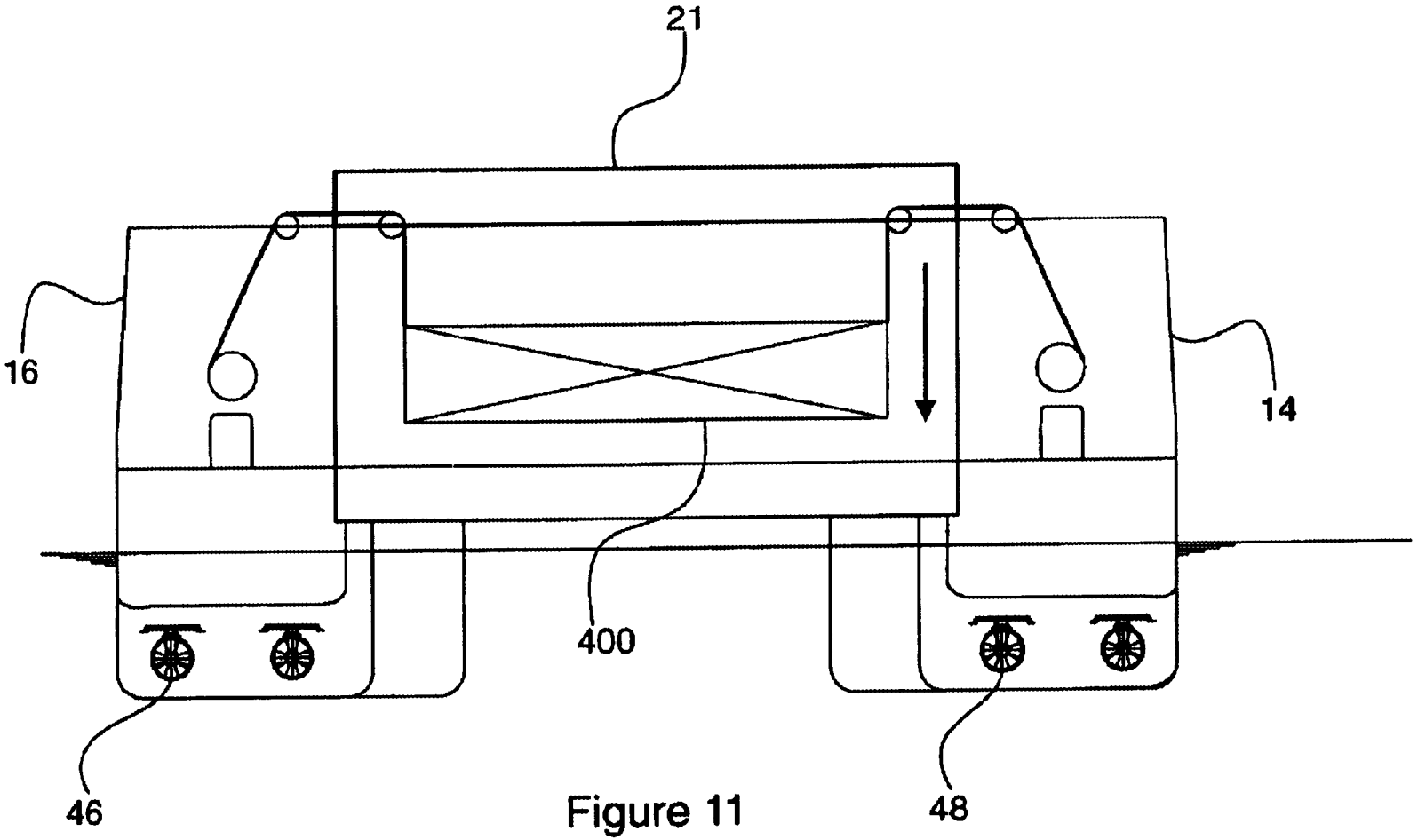
FIG. 11 is a stern view of the catamaran with a lift operation occurring.
Figure 12:
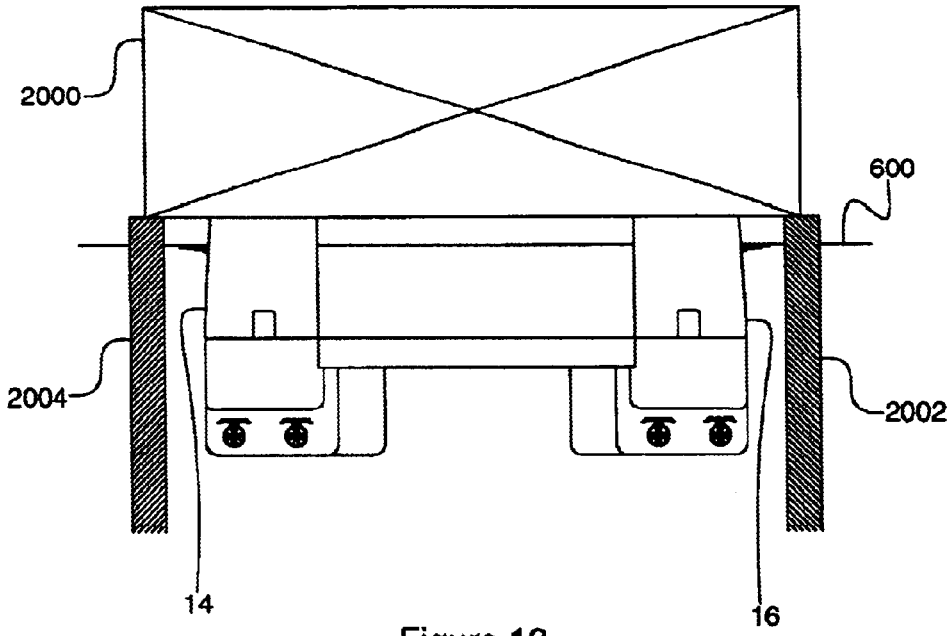
FIG. 12 is a stern view of a catamaran with an alternative lifting embodiment.

The vessel according to the present invention can be used, inter alia, as a transport vessel and/or lifting vessel. FIG. 11 shows one of the lifting vessel embodiments. A hatch (21) is disposed over the two load support columns (16) and (14) for carrying a load (400) using the two motion compensation systems and the vertical compensation system previously described. FIG. 12 shows a second type of lifting embodiment by the catamaran, wherein the water level (600) is shown and the load 2000 is being lifted.

Another lifting embodiment includes the process that with the aid of the ballast tanks, the vessel can be moved up and down in the water. If the ballast tanks are allowed to fill, the vessel will lower. In this position the vessel can be positioned underneath a load. If the ballast tanks are then pumped out again, the vessel will rise again and the load can be lifting either on the moveable support columns or on the solid support surface (12).

An aim of the present invention is to provide a vessel, which has a wider range of possible uses than the vessels known, including transport, lifting, and maintenance of objects at sea.

According to the invention the aim is firstly achieved in that the deck is at the level of the top of the floating body.

In one possible embodiment of the vessel according to the invention the vessel is essentially rectangular in plan view. At the four corner points of this rectangle there can be, respectively, at least two support columns at the stem of the vessel, the top of which support columns is used as a lifting surface. In the most preferred embodiment, at the bow of the vessel there are the two fixed columns, which can be used for storage of materials and for housing the crew. In this way an essentially symmetrical configuration is produced, with respect to the longitudinal axis of the vessel.

It should be noted that with this vessel, when a load is transferred from the vessel to an object at sea, the vessel and the object at sea, will be under the influence of the waves, the wind and the current, and relative to one another. When transferring a load from the vessel to the second object, or vice versa, there is in that case a risk that one of the parts will be damaged. The vertical and horizontal positioning systems described herein significantly reduce that change of damage and lower the risk substantially to crewmembers of the both vessels, providing a substantially safer environment, by at least 10% and up to 30% safer over known systems According to the invention it is possible that the tensioning means of the motion compensation system comprise a hydraulic cylinder, which is connected to an oil reservoir. The oil reservoir is used for discharging fluid from the reservoir to the cylinder. Via a movable wall, the reservoir adjoins a closed chamber that is filled with gas, such as air or nitrogen. The volume of the chamber is adjustable, in order to vary the stiffniess of the gas spring. With this arrangement it is possible that the chamber is connected to a gas line that is connected via shut-off valves to one or more gas bottles.

According to the invention it is furthermore advantageous that the vessel is provided with a lift construction that has a first and a second leg, which legs are positioned, respectively, on the first and the second float, the legs being joined at the top with the aid of a lifting beam, the lift construction further comprising lifting means, such as a lifting hook and a lifting line, and drive means for driving the lifting means.

The possible uses of the vessel according to the invention are yet further expanded by the presence of the lift construction. Because of the size of the vessel according to the invention and the associated stability of the vessel in the submerged state thereof, very heavy loads can be handled with the lifting means.

It is possible that at least the legs of the lift construction are of modular construction. The lift construction will not always be needed. It is advantageous if the lift construction can be assembled and dismantled in modules. The modules are preferably lifted one by one from the deck of the vessel. This lifting can, for example, take place by lifting up each of the modules between two columns. The winches with the aid of which the modules can be lifted up are positioned in these columns. At the point in time when the first module is lifted, a second module can be placed beneath this module, and so on. In this way the lift construction can be built up step by step and after use dismantled step by step.

According to the invention it is possible for the vessel to be provided with a tower or mast, in particular a drilling tower or drilling mast.

By installing a drilling tower or a drilling mast, such as, Applicant's Multipurpose Tower (MPT), on the vessel, the vessel can be used for drilling activities and when laying pipes on the sea bed. Because a drilling mast is not needed for all activities with the vessel, it is advantageous that the tower or the mast is housed in a module that is detachably fitted on the vessel. In this context it is preferable that this module is able to float.

In use, the vessel according to the invention can be sailed, in the submerged state, underneath the floating module. The vessel is then moved upwards, so that the module is in the correct position on the vessel. This means that no heavy cranes or other lifting means are needed in order to place the module on the vessel or to remove it from the vessel. The object to be lifted can be contained within the hull of the catamaran, or can extend past the external sides of the hull of the catamaran for lifting. In this way an object wider than the beam of the catamaran can be lifted or installed.

Furthermore, it is possible that the module also comprises a crane. The invention relates not only to a vessel, but also to a method for placing a load on a support, wherein the load is fixed on a vessel according to the invention. To use the vessel, the vessel is first brought into the first position thereof with the aid of the adjustment means. The vessel is then sailed to the support. At the support, the vessel is linked to the support with the aid of coupling means. The coupling means are provided with a spring, for taking up differences in movement between the vessel and the support with respect to terra firma. The spring stiffness of the coupling means is then allowed to increase stepwise or continuously, in order gradually to bring the movement of the vessel into correspondence with the movement of the support. When the movement of the vessel relative to terra firma is identical to that of the support, the vessel is moved into the second position thereof, in order to bring the load vertically downwards onto the support.

The catamaran can further comprises a mooring system consisting of at least one anchor secured to any one of the described winches. It should also be noted that throughout this case when the term line is used, it can also mean wires of cable or steel.

The present invention will be further explained with reference to the appended figures.

What is claimed is:

1. A submersible catamaran having a bow and a stern further comprising:

a. a first submergible float comprising a first float rounded triangular bow, a first float midsection, a first float tail, and first float stern;

b. a second submergible float comprising a second float rounded triangular bow, second float midsection, second float tail, and second float stern, wherein the second submergible float is disposed in a parallel relation to the first submergible float;

c. a solid support surface forming a top to the first and second submergible floats and wherein the solid support surface is adapted for supporting heavy loads and forming an air gap between the first and second submergible floats and the solid support surface and a slot opening disposed between first and second submergible float tails;

d. a first load supporting movable column disposed on the solid support surface;

e. a second load supporting movable column disposed on the solid support surface;

f. a first fixed column disposed on the first submergible float;

g. a second fixed column disposed on the second submergible float;

h. a first ballast system disposed in the first submergible float;

i. a second ballast system disposed the second submergible float, wherein the first and second ballast systems are adapted to raise and lower the catamaran with respect to the waterline;

j. a horizontal positioning system comprising:

i. at least three horizontal maneuvering winches;

ii. at least three maneuvering lines, each connected on one end to a winch and on the other end to an horizontal maneuvering object at sea; and iii. a controller for orienting the catamaran relative to the object at sea, and wherein the controller monitors the tension on the maneuvering lines and the controller initiates winch pay out of the maneuvering line when load on any one of the maneuvering lines exceeds a first preset limit, and further the controller initiates the maneuvering winch tensioning of the maneuvering line when tension on any one of the maneuvering lines falls below a second preset limit;

k. and a vertical positioning system for securing the catamaran to an object at sea;

i. a first line secured on one end substantially vertically to an object at sea;

ii. a second line secured on one end substantially vertically to the object at sea;

iii. a first motion compensation system disposed in the first load supporting moveable column and connected to the other end of the first line;

iv. a second motion compensation system disposed in the second load supporting moveable column and connected to the other end of the second line; and v. a control system for monitoring and controlling tension between first and second motion compensation systems and the object at sea.

2. The catamaran of claim 1, wherein the first and second load supporting movable columns are skidable over the solid support surface.

3. The catamaran of claim 1, wherein the first and second load supporting moveable columns are detachable from the solid support surface.

4. The catamaran of claim 1, wherein the first float tail and the second float tail have a tapered shape.

5. The catamaran of claim 1, wherein the slot opening is between 10 and 80 meters in width and 10–80 meters in length.

6. The catamaran of claim 5, wherein the slot opening is 50 meters in width.

7. The catamaran of claim 5, wherein the slot opening is U shaped.

8. The catamaran of claim 1, wherein the slot opening sized to position at least partially around a structure in a marine environment.

9. The catamaran of claim 1, wherein the solid support surface further comprises at least one removable hatch disposed therein.

10. The catamaran of claim 9, wherein the at least one hatch can float.

11. The catamaran of claim 9, wherein the at least one removable hatch can be placed between the bows of the first and second submergible floats to prevent water from coming over the solid support surface.

12. The catamaran of claim 1, further comprising a propulsion system having a first engine in the first submergible float driving a first rotatable propeller disposed on the first submergible float and a second engine ins aid second submergible float driving a second rotatable propeller disposed on the second submergible float.

13. The catamaran of claim 12, wherein the propulsion system further comprises a first bow thruster disposed in the first submergible float connected to the propulsion system, and a second bow thruster disposed in the second submergible float connected to the propulsion system.

14. The catamaran of claim 12, wherein the propulsion system further comprises a first stern thruster disposed in the first submergible float connected to the propulsion system and a second stern thruster disposed in the second submergible float.

15. The catamaran of claim 1, further comprising a propulsion system consisting of a plurality of bow and stem thrusters.

16. The catamaran of claim 1, further comprising at least one deck is disposed on at least one of the fixed columns.

17. The catamaran of claim 1, wherein at least one of the fixed columns further comprises crew accommodation.

18. The catamaran of claim 1, wherein at least one of the fixed columns comprises catamaran operational equipment.

19. The catamaran of claim 16, wherein the at least one deck further supports a helipad.

20. The catamaran of claim 1, wherein at least one of the fixed columns supports a bridge/command center.

21. The catamaran of claim 1, further comprising a dynamic positioning system to which the horizontal positioning system is connected.

22. The catamaran of claim 1, wherein the first and second motion compensation systems each comprises:

a. a winch;

b. at least one line connected to the winch and vertically connectable to an object at sea;

c. a tension measuring device connected to the line; and d. a motion control device connected to the line and winch for monitoring and controlling tension on the line.

23. The catamaran of claim 22, wherein between 1 and 16 winches can be used in each motion compensation system.

24. The catamaran of claim 1, wherein the first and second ballast systems can raise and lower the catamaran between 10 and 90 percent of the overall height of the catamaran.

25. The catamaran of claim 1, further comprises a mooring system consisting of at least one anchor secured to anyone of the winches.

26. The catamaran of claim 8, wherein the structure is a floating platform.

27. The catamaran of claim 8, wherein the structure is a fixed leg platform.

28. The catamaran of claim 8, wherein the structure is a floating vessel.

29. The catamaran of claim 1, further comprising between 2 and 10 load supporting moveable columns.

30. The catamaran of claim 1, wherein the ballast systems can ballast the catamaran to a draft selected from the group: a normal draft, a slightly submerged draft, wherein water fills the air gap between the first and second submergible floats and the solid support surface is above the water level, and a lower draft, wherein between 0 and 20 meters of water covers the solid support surface.

31. The catamaran of claim 1, wherein at least one of the lines are wires.

32. The catamaran of claim 1, wherein the columns are double hulled.

* * * * *